US011953008B2

(12) United States Patent
Hu et al.

(10) Patent No.: US 11,953,008 B2
(45) Date of Patent: Apr. 9, 2024

(54) AIR CONDITIONER AND COMPRESSOR

(71) Applicant: GREE GREEN REFRIGERATION TECHNOLOGY CENTER CO., LTD. OF ZHUHAI, Zhuhai (CN)

(72) Inventors: Yanjun Hu, Zhuhai (CN); Peizhen Que, Zhuhai (CN); Liu Xiang, Zhuhai (CN); Yuanbin Zhai, Zhuhai (CN); Wang Miao, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 447 days.

(21) Appl. No.: 17/312,215

(22) PCT Filed: Oct. 31, 2019

(86) PCT No.: PCT/CN2019/114765

§ 371 (c)(1),
(2) Date: Jun. 9, 2021

(87) PCT Pub. No.: WO2020/177357

PCT Pub. Date: Sep. 10, 2020

(65) Prior Publication Data

US 2022/0049701 A1 Feb. 17, 2022

(30) Foreign Application Priority Data

Mar. 1, 2019 (CN) ..... 201910154316.9

(51) Int. Cl.

| | |
|---|---|
| ***F04C 28/06*** | (2006.01) |
| ***F04C 18/32*** | (2006.01) |
| ***F04C 18/356*** | (2006.01) |
| ***F04C 23/00*** | (2006.01) |

(Continued)

(52) U.S. Cl.

CPC ..... *F04C 28/065* (2013.01); *F04C 18/322* (2013.01); *F04C 18/356* (2013.01);

(Continued)

(58) Field of Classification Search

CPC ..... F04C 28/065; F04C 18/322; F04C 23/001

See application file for complete search history.

(56) References Cited

U.S. PATENT DOCUMENTS 7,780,426 B2 * 8/2010 Cho ..... F01C 21/0863 418/60
2004/0208760 A1 10/2004 Yap et al.
2008/0101976 A1 * 5/2008 Kanayama ..... F04C 18/322 418/113

FOREIGN PATENT DOCUMENTS

CN 101839240 A 9/2010
CN 201779016 U 3/2011

(Continued)

OTHER PUBLICATIONS

International Search Report dated Feb. 5, 2020 in PCT/CN2019/114765 filed on Oct. 21, 2019, 2 pages.

(Continued)

*Primary Examiner* — Thomas Fink

(74) *Attorney, Agent, or Firm* — Oblon, McClelland, Maier & Neustadt, L.L.P.

(57) ABSTRACT

The present disclosure relates to an air conditioner and a compressor. The compressor includes: a first cylinder assembly, including a first cylinder body and a first sliding vane, a volume control assembly, including a pressure regulator; wherein the pressure regulator is provided with a storage cavity, and the storage cavity is communicated with the variable volume control cavity; wherein the first sliding vane is configured to slide in a reciprocating manner between the first compression cavity and the variable volume control cavity along the first sliding vane groove, to change the volume of the variable volume control cavity; and the refrigerant introduced into the variable volume control cavity flows between the variable volume control (Continued)

cavity and the storage cavity along with a change of the volume of the variable volume control cavity.

13 Claims, 8 Drawing Sheets

(51) Int. Cl.
*F04C 28/18* (2006.01)
*F04C 29/12* (2006.01)
*F25B 31/00* (2006.01)

(52) U.S. Cl.
CPC ..... *F04C 23/001* (2013.01); *F04C 28/18* (2013.01); *F04C 29/124* (2013.01); *F25B 31/00* (2013.01)

(56) References Cited

FOREIGN PATENT DOCUMENTS

| | | | | |
|---|---|---|---|---|
| CN | 102644596 | A | * | 8/2012 |
| CN | 103256223 | A | | 8/2013 |
| CN | 104595195 | A | * | 5/2015 |
| CN | 104595195 | A | | 5/2015 |
| CN | 207004813 | U | | 2/2018 |
| CN | 109723641 | A | | 5/2019 |
| CN | 209724653 | U | | 12/2019 |
| JP | 2003-201982 | A | | 7/2003 |
| JP | 2007092533 | A | * | 4/2007 |
| JP | 2006-21 4445 | A | | 8/2008 |
| JP | 5043382 | B2 | | 10/2012 |
| KR | 10-2010-0010294 | A | | 2/2010 |

OTHER PUBLICATIONS

Extended European Search Report dated Mar. 21, 2022 in European Patent Application No. 19918466.4, 8 pages.
Chinese Office Action issued in Chinese Patent Application No. 201910154316.9 on Dec. 16, 2023.

* cited by examiner

AIR CONDITIONER AND COMPRESSOR

RELATED APPLICATION

The present disclosure is a U.S. National Stage Application under 35 U.S.C. § 371 of International Patent Application No. PCT/CN2019/114765, filed on Oct. 31, 2019, which is based upon and claims priority to Chinese Patent Application No. 201910154316.9, filed on Mar. 1, 2019, the entire contents of all of which are incorporated herein by reference.

TECHNICAL FIELD

The present disclosure relates to the technical field of air conditioning, in particular to an air conditioner and a compressor.

BACKGROUND

A compressor is configured to compress refrigerant and is an important component in an air conditioner. Generally, in order to reduce the minimum output of the compressor for more precise temperature control and energy conservation and consumption reduction, the compressor is set to be with a plurality of cylinders, such that one of the cylinders serves as a variable volume cylinder. The variable volume cylinder is optionally in an operating state to provide a larger output together with other cylinders, or the variable volume cylinder is optionally in an idling state to allow the compressor to provide a smaller output.

Moreover, the variable volume cylinder includes a cylinder body, a rotor and a sliding vane, wherein the cylinder body is formed with a compression cavity and a first sliding vane groove communicated with the compression cavity, the rotor is arranged in the compression cavity in a rotatable manner, the sliding vane is arranged in the first sliding vane groove in a slidable manner and can be abutted against the rotor, one end, adjacent to the peripheral surface of the cylinder body, of the sliding vane and the inner wall of the first sliding vane groove enclose to form a variable volume control cavity, and the volume of the variable volume cavity at the tail part of the sliding vane varies along with reciprocating motion of the sliding vane in the first sliding vane groove of the variable volume cylinder. A change of volume of the variable volume control cavity will cause fluctuation of the pressure in the cavity, such that the frictional force between the sliding vane and the rotor is changed, when the contact force is too large, not only the power consumption of the compressor is increased, but also abnormal abrasion between the rotor and the sliding vane will be caused.

SUMMARY

According to one aspect of some embodiments of the present disclosure, the compressor includes:

a first cylinder assembly, including a first cylinder body and a first sliding vane, wherein the first cylinder body is provided with a first compression cavity, a variable volume control cavity and a first sliding vane groove, and the first sliding vane groove is constructed to be communicated between the first compression cavity and the variable volume control cavity;

a variable volume control assembly, including a pressure regulator; wherein the pressure regulator is provided with a storage cavity and a pressure input port, the pressure input port is communicated between the outside and the storage cavity, and the storage cavity is communicated with the variable volume control cavity; and wherein the first sliding vane is configured to slide in a reciprocating manner between the first compression cavity and the variable volume control cavity along the first sliding vane groove, to change the volume of the variable volume control cavity; moreover, the refrigerant introduced into the variable volume control cavity flows between the variable volume control cavity and the storage cavity along with the change of the volume of the variable volume control cavity.

In the above compressor, along with reciprocating movement of the first sliding vane, the volume of the variable volume control cavity will be changed accordingly. When the volume of the variable volume control cavity becomes small, the pressure inside the variable volume control cavity is increased, the refrigerant in the variable volume control cavity flows to the storage cavity under the effect of pressure difference, to buffer the change of the refrigerant pressure in the variable volume control cavity, slow down the increase of pressure, and prevent large fluctuation of the refrigerant pressure in the variable volume control cavity. Similarly, when the volume of the variable volume control cavity becomes large, the pressure inside the variable volume control cavity is reduced, the refrigerant in the storage cavity flows to the variable volume control cavity under the effect of pressure difference, to buffer the change of the refrigerant pressure in the variable volume control cavity, slow down the increase of pressure, and prevent large fluctuation of the refrigerant pressure in the variable volume control cavity. Therefore, when the volume of the variable volume control cavity is changed, the refrigerant in the variable volume control cavity adaptively flows to the storage cavity, or the refrigerant in the storage cavity is adaptively supplemented to the variable volume control cavity, to buffer the pressure change in the variable volume control cavity, prevent severe fluctuation of pressure in the variable volume control cavity, and further prevent abnormal abrasion between the sliding vane and the first roller after the sliding vane is subject to greater pressure, thereby protecting the sliding vane and the first roller, and improving overall performance of the compressor.

According to one aspect of some embodiments of the present disclosure, the compressor includes:

a first cylinder assembly, including a first cylinder body and a first sliding vane, the first cylinder body is formed with a first compression cavity, a variable volume control cavity and a first sliding vane groove, wherein the first sliding vane groove communicates the first compression cavity with the variable volume control cavity, the first sliding vane is arranged in the first sliding vane groove in a slidable manner, and a part of the first sliding vane is configured to extend into the first compression cavity, and another part is configured to extend into the variable volume control cavity;

a variable volume control assembly, including a pressure regulator, wherein the pressure regulator is provided with a storage cavity, the storage cavity is configured to accommodate refrigerant, and the storage cavity is communicated with the variable volume control cavity; and wherein, the first sliding vane is so configured that when the first sliding vane slides along the first sliding vane groove, the size of the part extending into the variable volume control cavity is changed, such that the volume of the variable volume control cavity is changed accordingly; along with the change of the volume of the variable volume control cavity, refrigerant is capable of flowing between the variable volume control cavity and the storage cavity.

In some embodiments, the effective volume of the storage cavity is Va, the volume of the variable volume control cavity is Vb, the maximum variable value of Vb that varies along with the sliding of the first sliding vane is Vbmax, and the relationship between Va and Vbmax satisfies the following equation: Va>5Vbmax.

In some embodiments, the relationship between Va and Vbmax satisfies the following equation: Va>10Vbmax.

In some embodiments, the variable volume control assembly further includes a control pipe, and the control pipe communicates the storage cavity with the variable volume control cavity.

In some embodiments, the minimum sectional area of the control pipe is S, the maximum sliding speed of the first sliding vane is Cmax, the thickness of the first sliding vane is b, the height of the first compression cavity is H, and $S>(1.57\times10^{-5})bHCmax$.

In some embodiments, the relationship between S and bHCmax satisfies the following equation: $S>(3.15\times10^{-5})bHCmax$.

In some embodiments, the pressure regulator is provided with an inlet flow channel communicated between the storage cavity and the pressure input port, the plane in which the communicated part between the inlet flow channel and the storage cavity is arranged is the first boundary surface, the plane in which the end, communicated with the storage cavity, of the control pipe is arranged is the second boundary surface, and the volume between the first boundary surface and the second boundary surface in the storage cavity is the effective volume.

In some embodiments, the variable volume control assembly further includes a control pipe, and the control pipe communicates the storage cavity with the variable volume control cavity;

the variable volume control assembly further includes an inlet flow channel, and the inlet flow channel includes a pressure input port being configured to introduce refrigerant, and an outlet communicated with the storage cavity; and the plane in which the outlet is arranged is the first boundary surface, the plane in which the end, communicated with the storage cavity, of the control pipe is arranged is the second boundary surface, and the volume between the first boundary surface and the second boundary surface in the storage cavity is the effective volume of the storage cavity.

In some embodiments, one end of the control pipe extends into the storage cavity and protrudes out of the bottom wall of the storage cavity.

In some embodiments, one end of the control pipe extends into the storage cavity through the bottom of the storage cavity, and extends to the inside of the storage cavity.

In some embodiments, the compressor further includes a second cylinder assembly, the second cylinder assembly includes a second cylinder body, a second roller, an upper flange and a baffle plate, the second cylinder body is provided with a second compression cavity, the second roller is arranged in the second compression cavity in a rotatable manner, and the baffle plate is arranged between the first cylinder body and the second cylinder body, and the upper flange is arranged on a side, far away from the baffle plate, of the second cylinder body;

wherein the first cylinder assembly further includes a first roller arranged in the first compression cavity in a rotatable manner, the clearance between the first roller and the baffle plate is δa, the clearance between the second roller and the upper flange is δb, and δa>δb.

In some embodiments, δa>δb+4 μm.

In some embodiments, 20 μm<δa<30 μm.

In some embodiments, 22 μm<δa<26 μm.

According to another aspect of some embodiments of the present disclosure, the air conditioner includes the above compressor.

DETAILED DESCRIPTION

The technical solutions in the embodiments will be clearly and completely described below in combination with the accompanying drawings in the embodiments of the present disclosure. Obviously, the described embodiments are merely a part but not all of the embodiments of the present disclosure. Based on the embodiments of the present disclosure, all the other embodiments obtained by those skilled in the art without any creative effort shall fall within the protection scope of the present disclosure.

In the description of the present disclosure, it should be noted that, the orientation or positional relationship indicated by such terms as "center", "longitudinal", "horizontal", "front", "back", "left", "right", "vertical", "horizontal", "top", "bottom", "inside" and "outside" is the orientation or positional relationship based on the accompanying drawings. Such terms are merely for the convenience of description of the present disclosure and simplified description, rather than for indicating or implying that the device or element referred to must be arranged in a certain orientation or must be constructed and operated in a certain orientation, therefore, the terms cannot be understood as a limitation to the protection scope of the present disclosure.

Aiming at the problem of abnormal abrasion of the sliding vane and the roller in the variable volume cylinder, the present disclosure provides a compressor with less abrasion between the sliding vane and the roller.

Figure 1:
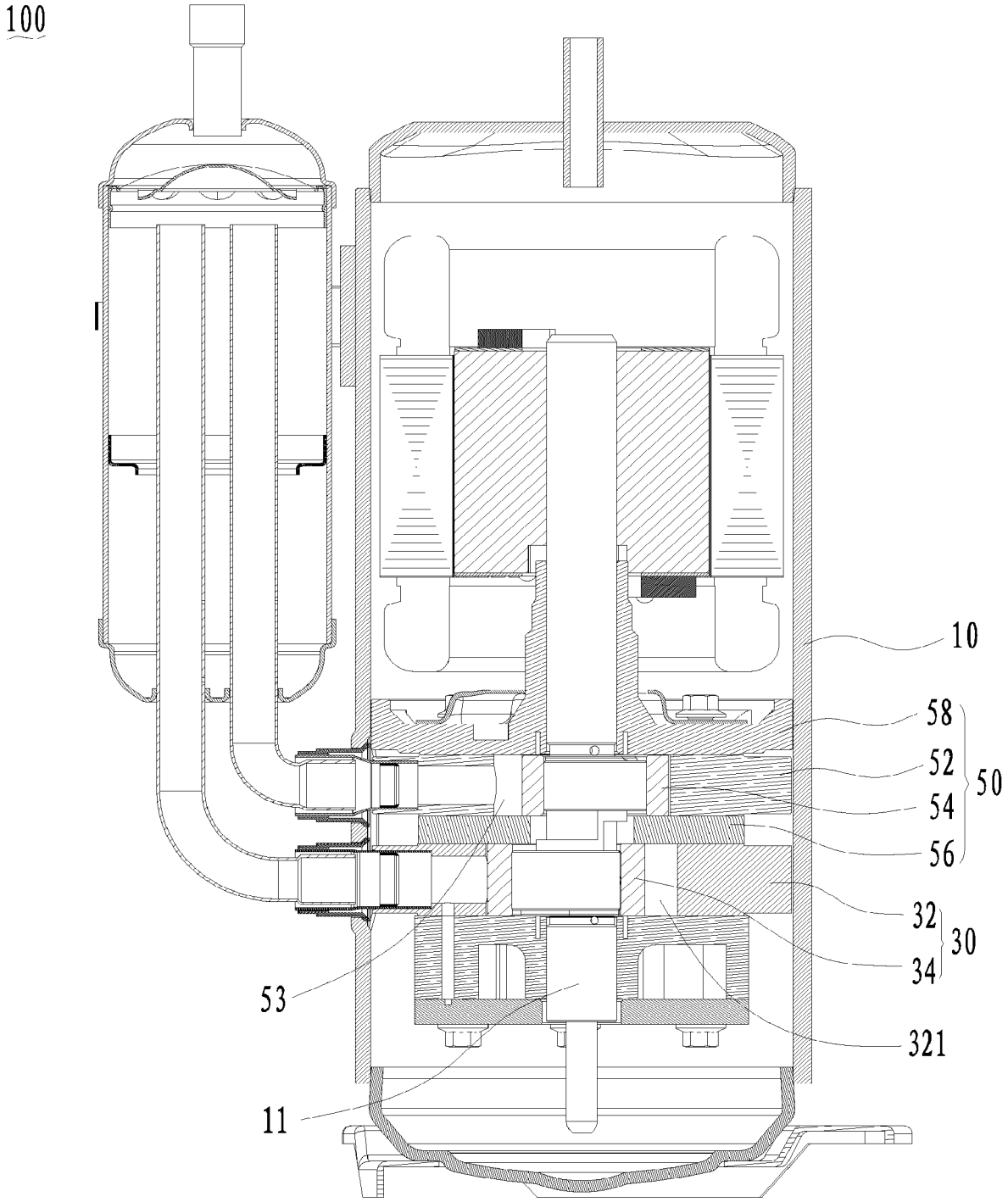
FIG. 1 is a structural schematic diagram of a viewing angle of a compressor provided in some embodiments of the present disclosure.

As shown in FIG. 1, in some embodiments of the present disclosure, a compressor 100 is provided. The compressor 100 includes a housing 10, a first cylinder assembly 30 and a second cylinder assembly 50, wherein the first cylinder assembly 30 and the second cylinder assembly 50 are arranged in the housing 10, and the first cylinder assembly 30 includes a variable volume cylinder, and the second cylinder assembly 50 includes a non-variable volume cylinder. When the second cylinder assembly 50 is in an operating state, the first cylinder assembly 30 is optionally in an operating state or an idling state (that is, the roller is rotated eccentrically along with the crankshaft, but will not compress air). When the first cylinder assembly 30 is in an idling state and the second cylinder assembly 50 is in an operating state, the compressor 100 will obtain a smaller output, when the first cylinder assembly 30 and the second assembly 50 are both in an operating state, the compressor 100 will obtain a larger output, thereby achieving more precise temperature control and energy conservation and consumption reduction through adjusting the state of the first cylinder body 32 to adjust the overall output of the compressor 100.

Figure 2:
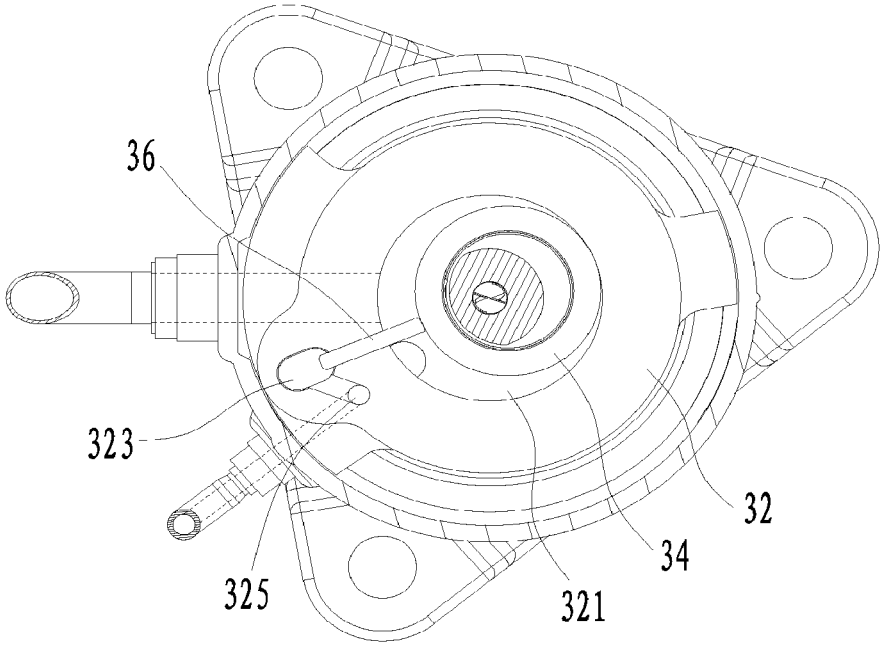
FIG. 2 is a structural schematic diagram of the compressor shown in FIG. 1 when a first sliding vane extends to the maximum.
Figure 3:
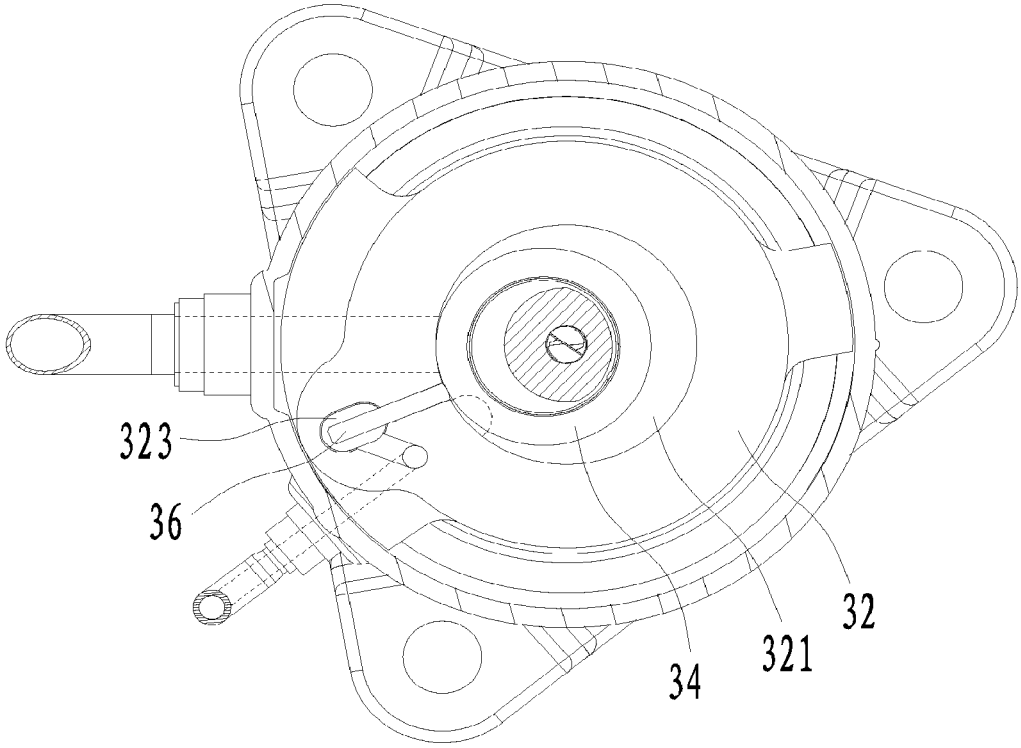
FIG. 3 is a structural schematic diagram of the compressor shown in FIG. 1 when a first sliding vane extends to the minimum.
Figure 4:
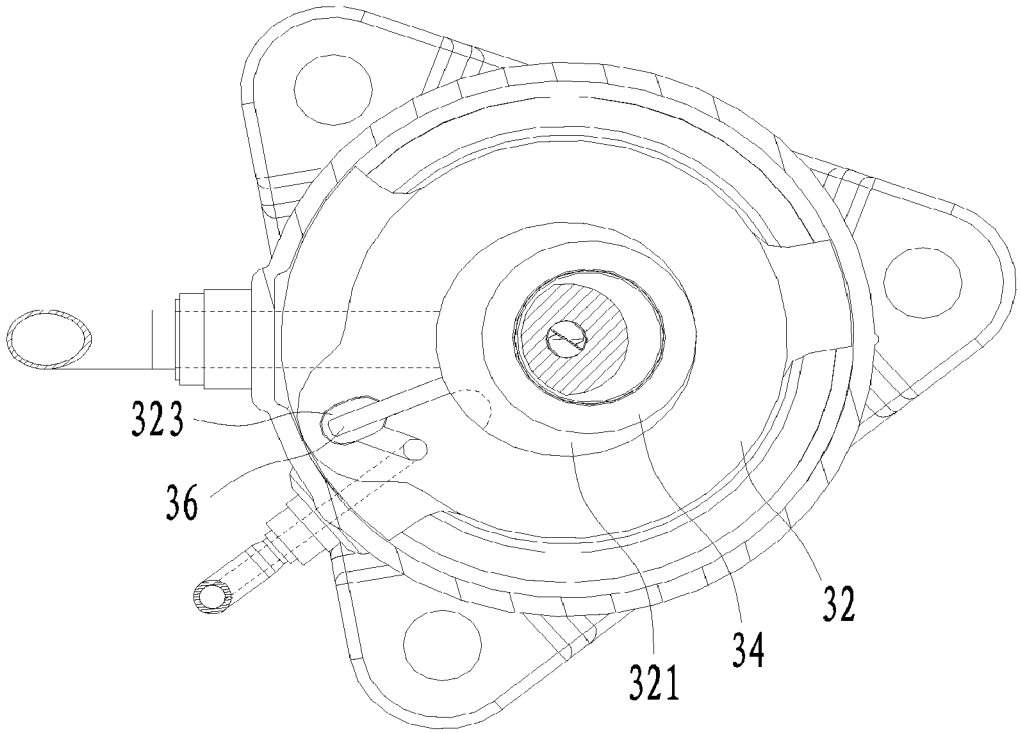
FIG. 4 is a structural schematic diagram when a first cylinder assembly in the compression shown in FIG. 1 is in an idling state.

As shown in FIG. 2 to FIG. 4, the first cylinder assembly 30 includes a first cylinder body 32, a first roller 34 and a first sliding vane 36, wherein the first cylinder body 32 is formed with a first compression cavity 321, a variable volume control cavity 323 and a first sliding vane groove, and the first sliding vane groove communicates the first compression cavity 321 with the variable volume control cavity 323.

The first sliding vane 36 is slidably arranged in the first sliding groove, and a part of the first sliding vane 36 is configured to extend into the first compression cavity 321, and another part of the first sliding vane 36 is configured to extend into the variable volume control cavity 323.

The first sliding vane 36 is configured to slide in a reciprocating manner between the first compression cavity 321 and the variable volume control cavity 323 along the first sliding vane, to change the volume of the variable volume control cavity 323; that is to say, when the first sliding vane 36 slides along the first sliding vane groove, the first sliding vane 36 will stretch in the variable volume control cavity 323 communicated with the first sliding vane groove and change the volume of the variable volume control cavity 323.

The first roller 34 is arranged in the first compression cavity 321 in a rotatable manner, and can be abutted against the first sliding vane 36, and pushes the first sliding vane 36 to slide in a reciprocating manner along the first sliding vane groove when the first roller 34 rotates eccentrically in the first compression cavity 321.

The first sliding vane 36 is so configured that the size of the another part extending into the variable volume control cavity 323 is changed when the first sliding vane 36 slides along the first sliding vane groove, such that the volume of the variable volume control cavity 323 is changed accordingly; along with the change of the volume of the variable volume control cavity 323, refrigerant is capable of flowing between the variable volume control cavity 323 and the storage cavity 42.

Wherein high-pressure refrigerant or low-pressure refrigerant is introduced optionally into the variable volume control cavity 323 through a pressure input port 44. As shown in FIG. 2 to FIG. 3, when high-pressure refrigerant is introduced into the variable volume control cavity 323, the first sliding vane 36 is separated from the limiting piece under the effect of high pressure and is abutted against the first roller 34, and the compressor 100 is operated with double cylinders; as shown in FIG. 4, when low-pressure refrigerant is introduced into the variable volume control cavity 323, the first sliding vane 36 is fixed under the effect of the limiting piece and is separated from the first roller 34, the first cylinder assembly 30 is in an idling state, and the compressor 100 is operated with a single cylinder.

Figure 5:
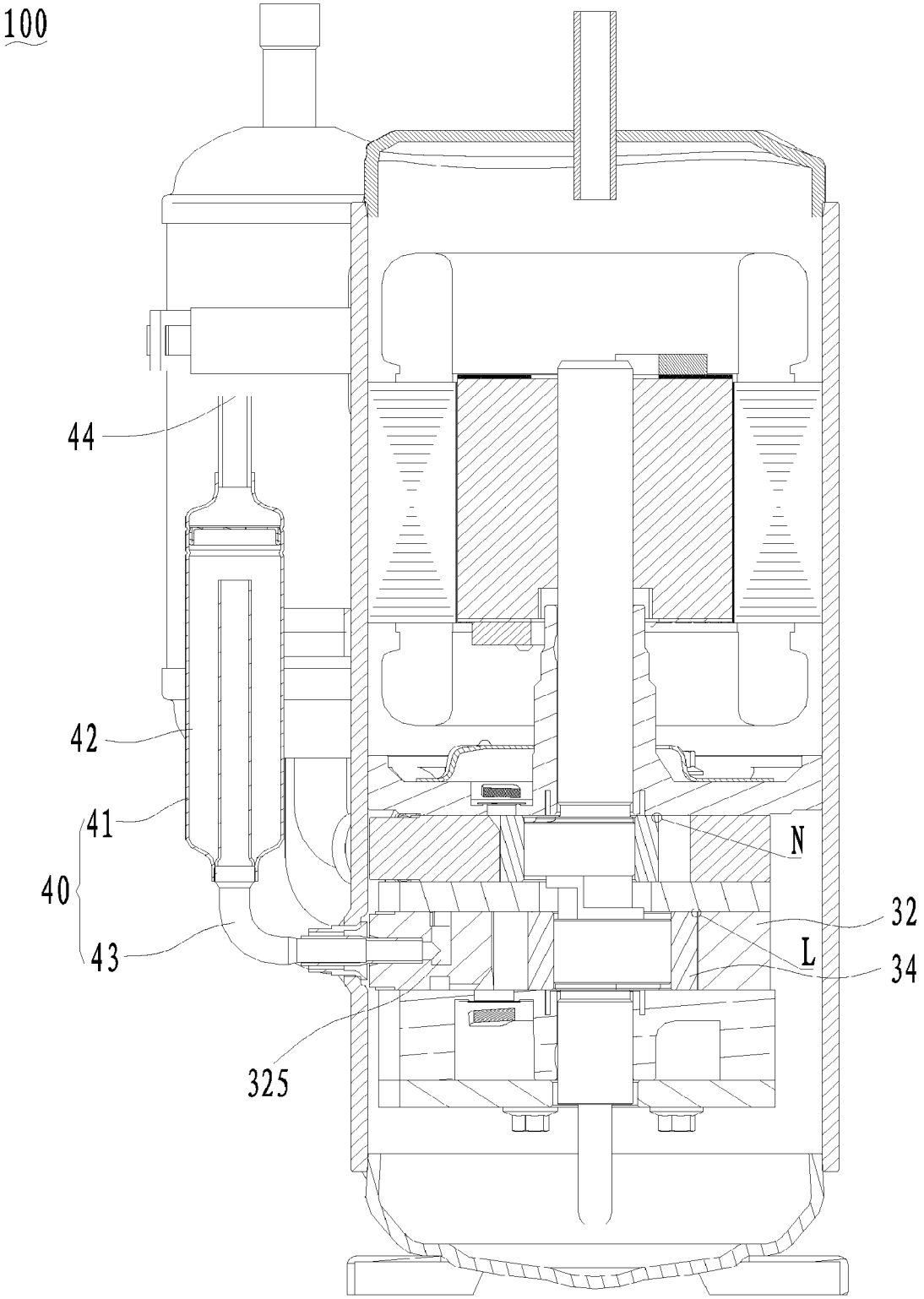
FIG. 5 is a structural schematic diagram of another viewing angle of the compressor shown in FIG. 1.
Figure 6:
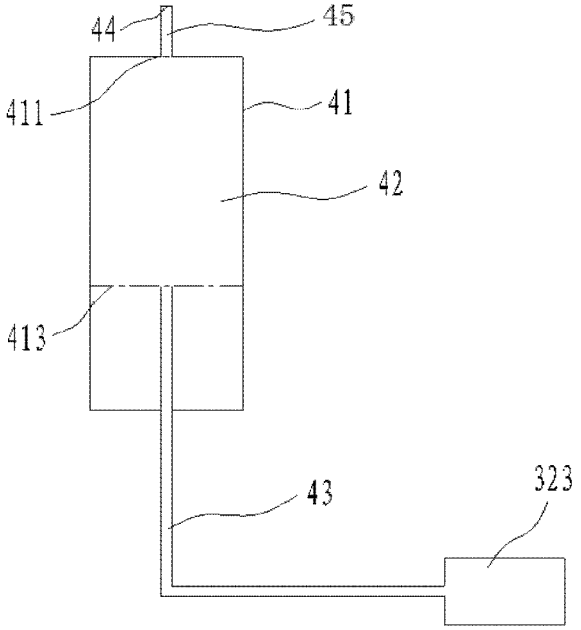
FIG. 6 is a structural schematic diagram of a variable volume control assembly in the compressor shown in FIG. 5.

As shown in FIG. 5 to FIG. 6, the compressor 100 further includes a variable volume control assembly 40, the variable volume control assembly 40 includes a pressure regulator 41, the pressure regulator 41 is provided with a storage cavity 42 and a pressure input port 44, the pressure input port 44 is communicated between the outside and the storage cavity 42, and the storage cavity 42 is communicated with the variable volume control cavity 323.

After refrigerant of a higher pressure is introduced into the storage cavity 42 through the pressure input port 44, refrigerant of a higher pressure enters the variable volume control cavity 323 of the first cylinder body 32 from the storage cavity 42, the first sliding vane 36 is separated from the limiting piece under the effect of the refrigerant of a higher pressure in the variable volume control cavity 323 and is abutted against the first roller 34, and divides the first compression cavity 321 into an air suction cavity and an air outlet cavity, such that the first cylinder assembly 30 enters an operating state to compresses refrigerant.

When refrigerant of a lower pressure is introduced into the storage cavity 42 through the pressure input port 44, the refrigerant of a lower pressure enters the variable volume control cavity 323 of the first cylinder body 32 from the storage cavity 42, refrigerant of a lower pressure in the variable volume control cavity 323 allows matching between the limiting piece and the first sliding vane 36, the first sliding vane 36 is fixed in the initial position and is separated from the first roller 34, and the first sliding vane 36 cannot divide the first compression cavity 321 into an air suction cavity and an air outlet cavity, such that the first roller 34 cannot compress air, and the first cylinder assembly 30 is in an idling state.

Further, when the first cylinder assembly 30 is in an operating state, the first sliding vane 36 is abutted against the first roller 34, and the first roller 34 rotates to push the first sliding vane 36 to move in the first sliding vane groove in a reciprocating manner, and along with the reciprocating movement of the first sliding vane 36, the volume of the variable volume control cavity 323 is changed accordingly.

Figure 7:
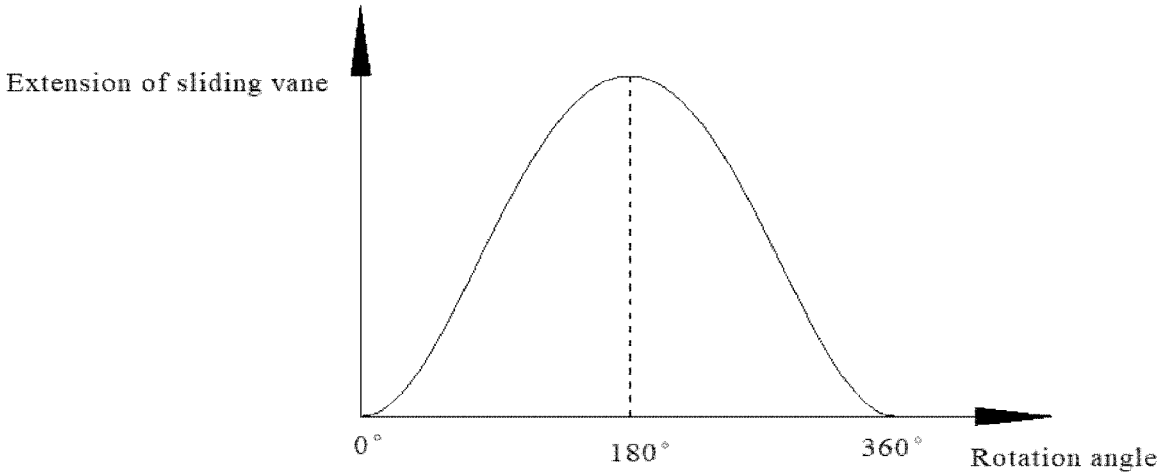
FIG. 7 is a curve graph of the relationship between the first sliding vane extension and the crankshaft rotation angle in the compressor shown in FIG. 1.

As shown in FIG. 7, the extension of the first sliding vane 36 relative to the first sliding vane groove is related to the rotation angle of the crankshaft 11 and the first roller 34. During the rotating process of the first roller 34, the extension of the first sliding vane 36 firstly increases and then decreases, and the volume of the variable volume control cavity 323 also firstly increases and then decreases, and so on and so forth.

Specifically, when the volume of the variable volume control cavity 323 becomes small, the pressure in the variable volume control cavity 323 is increased, the refrigerant in the variable volume control cavity 323 flows to the storage cavity 42 under the effect of pressure difference, to buffer the change of pressure of the refrigerant in the variable volume control cavity 323, slow down the increase of pressure, and prevent large fluctuation of the pressure of the refrigerant in the variable volume control cavity 323.

Similarly, when the volume in the variable volume control cavity 323 becomes large, the pressure in the variable volume control cavity 323 is reduced, the refrigerant in the storage cavity 42 flows to the variable volume control cavity 323 under the effect of pressure difference, to buffer the pressure change of the refrigerant in the variable volume control cavity 323, slow down the reduction of pressure, and prevent large fluctuation of pressure of the refrigerant in the variable volume control cavity 323.

In this way, when the volume in the variable volume control cavity 323 is changed, the refrigerant in the variable volume control cavity 323 adaptively flows to the storage cavity 42, or the refrigerant in the storage cavity 42 is adaptively supplemented to the variable volume control cavity 323, to balance pressure in the variable volume control cavity 323, and prevent severe fluctuation of pressure in the variable volume control cavity 323, and further prevent abnormal abrasion between the sliding vane and the first roller 34 after the sliding vane is subject to greater pressure, thereby protecting the sliding vane and the first roller 34, and improving overall performance of the compressor 100.

The variable volume control assembly 40 further includes a control pipe 43, the control pipe 43 communicates the storage cavity 42 with the variable volume control cavity 323, and refrigerant is transported between the storage cavity 42 and the variable volume control cavity 323 through the control pipe 43, to balance pressure fluctuation caused by the change of volume in the variable volume control cavity 323.

In some embodiments, the effective volume of the storage cavity 42 is Va, the volume of the variable volume control cavity 323 is Vb, and the maximum variable value of Vb that varies along with the sliding of the sliding vane is Vbmax, and the relationship between Va and Vbmax satisfies the following equation: Va>5Vbmax, to ensure that the effective volume Va of the storage cavity 42 is large enough, so as to provide sufficient refrigerant to buffer the pressure change in the variable volume control cavity 323.

Figure 8:
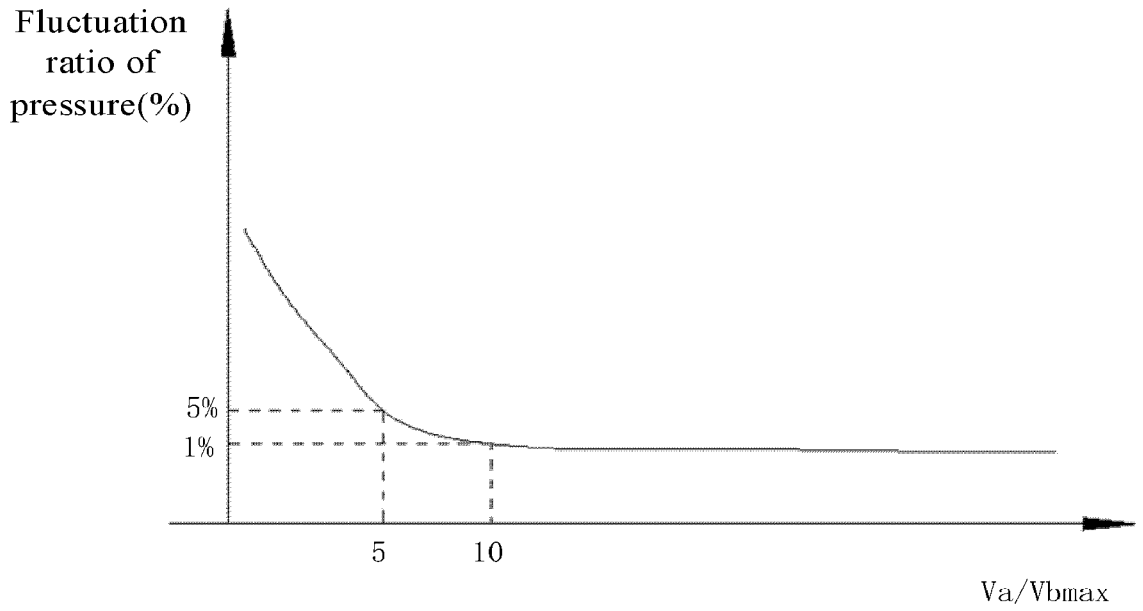
FIG. 8 is a curve graph of the relationship between the pressure fluctuation ratio in the variable volume control cavity and Va/Vbmax in the compressor shown in FIG. 1.

As shown in FIG. 8, it can be seen from the relation curve of Va and Vbmax that, when Va>5Vbmax, the fluctuation ratio of pressure in the variable volume control cavity 323 is less than 5%, and the fluctuation range is small. Wherein the pressure fluctuation ratio refers to the ratio of the difference value between the maximum pressure and the minimum pressure in the variable volume control cavity 323 to the average pressure.

Further, in some other embodiments, the relationship between Va and Vbmax satisfies the following equation: Va>10Vbmax, to ensure that the effective volume of the storage cavity 42 is large enough, so as to provide sufficient refrigerant to buffer the pressure change in the variable volume control cavity 323.

As shown in FIG. 8, it can be seen from the relation curve of Va and Vbmax that, when Va>10Vbmax, the fluctuation ratio of pressure in the variable volume control cavity 323 is less than 1%, and the fluctuation range is small.

As shown in FIG. 6, the variable volume control assembly 40 further includes an inlet flow channel 43, and the inlet flow channel 43 includes a pressure input port 44 being configured to introduce refrigerant, and an outlet communicated with the storage cavity 42.

Refrigerant flows to the storage cavity 42 from the inlet flow channel 45. Moreover, the plane in which the communicated part between the inlet flow channel 45 and the storage cavity 42 (the outlet of the inlet flow channel 45) is arranged is the first boundary surface 411, the plane in which the end, communicated with the storage cavity 42, of control pipe 43 is arranged is the second boundary surface 413, and the volume between the first boundary 411 and the second boundary 413 in the storage cavity 42 is the effective volume Va.

When refrigerant enters the area in which the effective volume is arranged, the refrigerant will enter the storage cavity 42 through the control pipe 43, and the refrigerant in the effective volume is reliably used to buffer fluctuation of pressure in the variable volume control cavity 323.

One end of the control pipe 43 extends into the storage cavity 42 through the bottom of the storage cavity 42, and extends to the inside of the storage cavity 42.

Optionally, one end of the control pipe 43 extends into the storage cavity 42 and protrudes out of the bottom wall of the storage cavity 42, and the control pipe 43 is set to protrude at one end of the storage cavity 42, to facilitate flow of the refrigerant between the storage cavity 412 and the control pipe 43.

As shown in FIG. 2 and FIG. 5, specifically, the first cylinder body 32 is further formed with an inlet channel 325 communicated with the variable volume control cavity 323, one end of the control pipe 43 is communicated with the inlet channel 325, and the variable volume control assembly 40 is communicated with the variable volume control cavity 323 through the inlet channel 325.

The pressure fluctuation in the variable volume control cavity 323 is related to the effective volume Va of the storage cavity 42, and is also related to the movement speed of the first sliding vane 36. If the first sliding vane 36 moves too fast, the refrigerant cannot flow between the variable volume control cavity 323 and the storage cavity 42 in time, and the pressure fluctuation in the variable volume control cavity 323 cannot be effectively mitigated. The movement speed of the first sliding vane 36 can be calculated according to the following formula:

$$C = 2\pi R\varepsilon f\left(\sin\varphi + \frac{\varepsilon}{2(1-\varepsilon)}\sin(2\varphi)\right)$$

In the formula, R is the inner radius of the first cylinder body 32, with a unit of mm;

ε is the ratio of the eccentricity e of the crankshaft eccentric section arranged in the first cylinder 32 to $$R\left(\text{i.e., } \frac{e}{R}\right);$$

f is the operating frequency of the compressor 100, with a unit of Hz;

φ is the crankshaft rotation angle with a unit of radians, and the rotation angle is 0 at the position shown in FIG. 3.

In the above formula, the inner diameter of the first cylinder body 32 almost has no influence on the movement speed of the first sliding vane 36, and under the influence of the design structure, the range of the eccentricity of the crankshaft is generally small, and its influence on the movement speed of the sliding vane is also not large, therefore, the operating frequency f of the compressor 100 has a greater influence on the movement speed of the first sliding vane 36.

Figure 9:
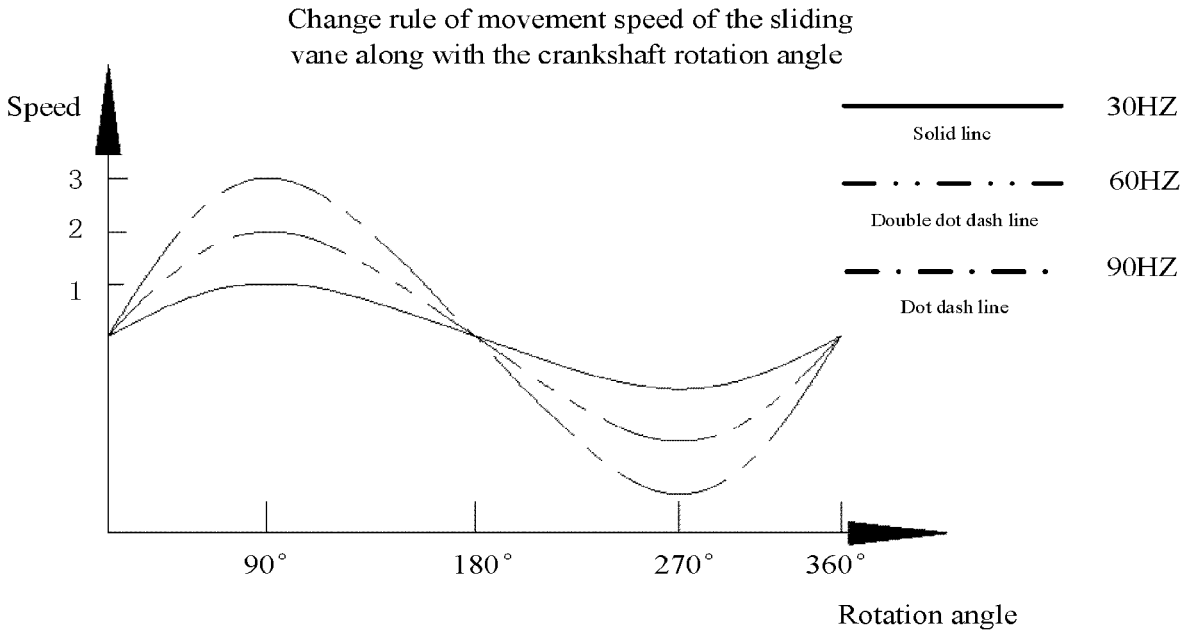
FIG. 9 is a curve graph of the relationship between the movement speed of the first sliding vane and the crankshaft rotation angle in the compressor shown in FIG. 1.

As shown in FIG. 9, the speed of the first sliding vane 36 is changed along with the change of the rotation angle at different operating frequencies, and the maximum value of the movement speed of the first sliding vane 36 at a certain frequency is defined as Cmax, in a unit of mm/s.

Further, the minimum sectional area of the control pipe 43 is defined as S (sectional area: the flow area perpendicular to the flow direction of the refrigerant within the pipe), the thickness of the sliding vane is b, and the height of the first compression cavity 321 is H. The minimum sectional area S satisfies the following relationship: $S>(1.57\times10^{-5})bHCmax$, ensuring that the sectional area of the control pipe 43 is large enough that even if the first sliding vane 36 moves faster, the refrigerant will still flow between the storage cavity 42 and the variable volume control cavity 323 through the control pipe 43, and the control pipe 43 will allow the refrigerant to flow in time to prevent large pressure fluctuation in the variable volume control cavity 323.

Figure 10:
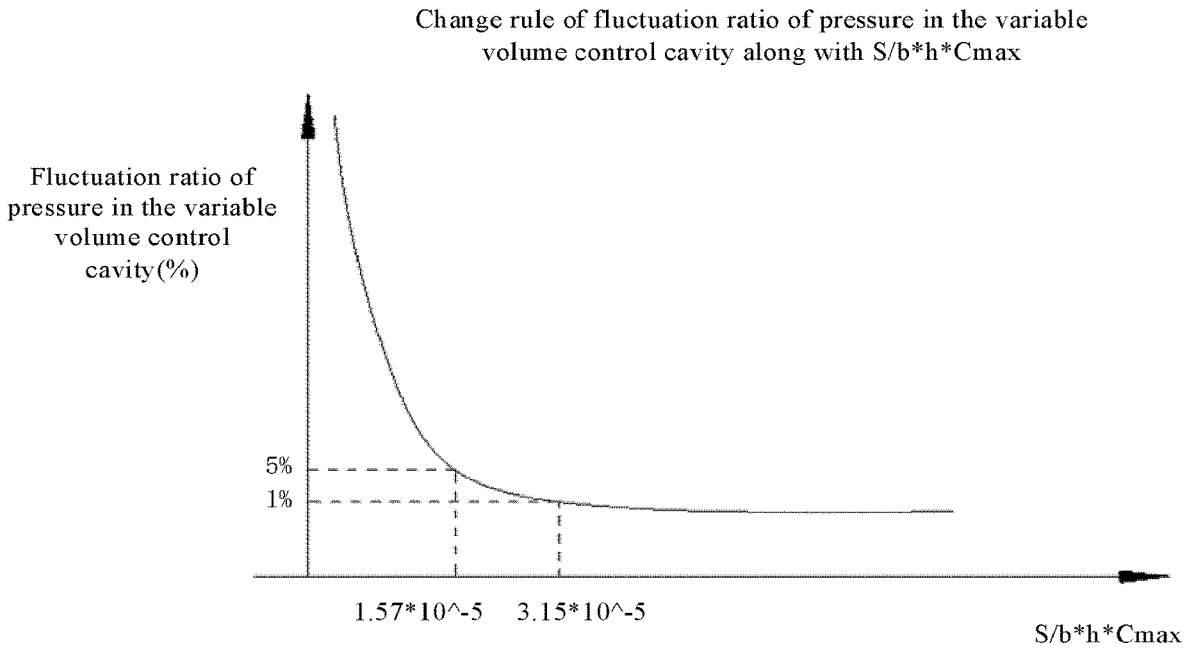
FIG. 10 is a curve graph of the relationship between the pressure fluctuation ratio in the variable volume control cavity and S/bHCmax in the compressor shown in FIG. 1.

As shown in FIG. 10, when the first cylinder assembly 30 is in an operating state, if $S>(1.57\times10^{-5})bHCmax$, the fluctuation ratio of pressure in the variable volume control cavity 323 is less than 5%; further, when $S>(3.15\times10^{-5})bHCmax$, the fluctuation ratio of pressure in the variable volume control cavity 323 is less than 1%, and pressure fluctuation is less. Wherein, the fluctuation ratio of pressure refers to the ratio of the difference value between the maximum pressure and minimum pressure in the variable volume control cavity 323 to the average pressure.

As shown in FIG. 1, the second cylinder assembly 50 includes a second cylinder body 52, a second roller 54 and a second sliding vane 56, the second cylinder body 52 is formed with a second compression cavity 53 and a second sliding vane groove (not shown in the figure) communicated with the second compression cavity 53, the second roller 54 is arranged in the second compression cavity 53 in a rotatable manner, the second sliding vane 56 is arranged in the second sliding vane groove in a slidable manner and is always abutted against the second roller 54, and the second compression cavity 53 is always divided into two sub-cavities by the second sliding vane 56, and will always compress refrigerant when the second roller 54 is rotated. That is, when the crankshaft assembling the second roller 54 is in a rotating state, the second cylinder assembly 50 is in an operating state, and the second cylinder assembly 50 has no idling state.

The second cylinder assembly 50 further includes a baffle plate 56 and an upper flange 58, and the baffle plate 56 is arranged between the first cylinder body 32 and the second cylinder body 52, to separate the first cylinder assembly 30 from the second cylinder assembly 50. The upper flange 58 is arranged on a side, far away from the baffle plate 56, of the second cylinder body 52, and closes the opening on the top of the second cylinder body 52 through the upper flange 58, to form a sealed second compression cavity 53. When the first cylinder assembly 30 is unloaded in an idling state and the second cylinder assembly 50 is in an operating state, the first cylinder assembly 30 does not compress air, but the first roller 34 in the first cylinder assembly 30 is rotated in the first compression cavity 321 along with a crankshaft, a certain amount of power consumption (Wb) will be consumed due to contact and friction between the rotating first roller 34 and the baffle plate 56. The power consumption is inversely proportional to the clearance between the first roller 34 and the baffle plate 56, that is, the larger the clearance, the lower the power consumption.

Figure 11:
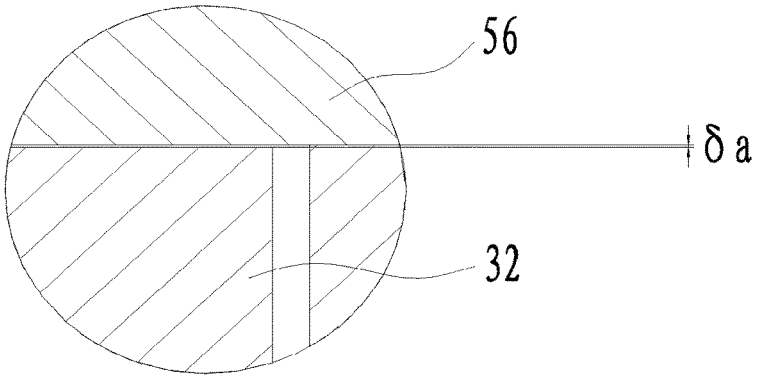
FIG. 11 is a partial enlarged schematic diagram of the compressor shown in FIG. 5 at L.
Figure 12:
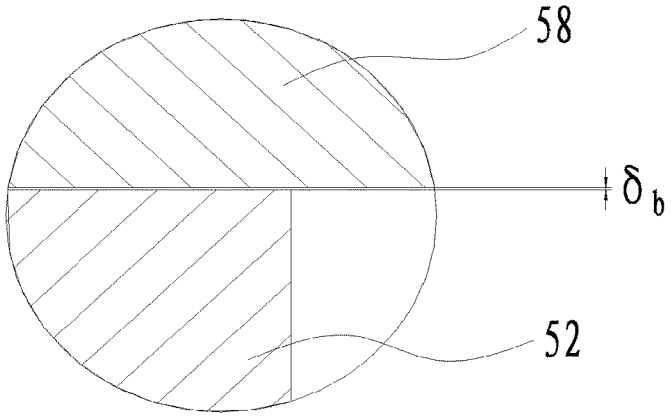
FIG. 12 is a partial enlarged schematic diagram of the compressor shown in FIG. 5 at N.

As shown in FIGS. 11-12, wherein the clearance between the first roller 34 and the baffle plate 56 is δa, the clearance between the second roller 54 and the upper flange 58 is δb, δa is set to be greater than δb, to avoid that the clearance δa between the first roller 34 and the baffle plate 56 is too small, and reduce the power consumption of the first cylinder assembly 30 during idling. Optionally, δa>δb+4 μm, and the power consumption is lower.

Moreover, when the first cylinder assembly 30 is unloaded in an idling state and the second cylinder assembly 50 is in an operating state, the clearance δa between the first roller 34 and the baffle plate 56 and the clearance δb between the second roller 54 and the upper flange 58 will influence the loss of refrigeration capacity of the compressor 100.

When the first cylinder assembly 30 is unloaded in an idling state, a pressure difference exists at two sides of the first roller 34, the refrigerant will leak out of the first compression cavity 321 from the high-pressure side of the first roller 34 through the clearance δa, thereby causing a loss of refrigeration capacity Qa, and further influencing the compression performance of the whole compressor 100 on the refrigerant.

The loss of refrigeration capacity Qa is proportional to the third power of the clearance δa, the larger the clearance δa, the larger the leakage, and the larger the loss of refrigeration capacity Qa. The size of the clearance δa is proportional to the loss of refrigeration capacity Qa, and the size of the clearance δa is inversely proportional to the power consumption Wb generated by friction.

Figure 13:
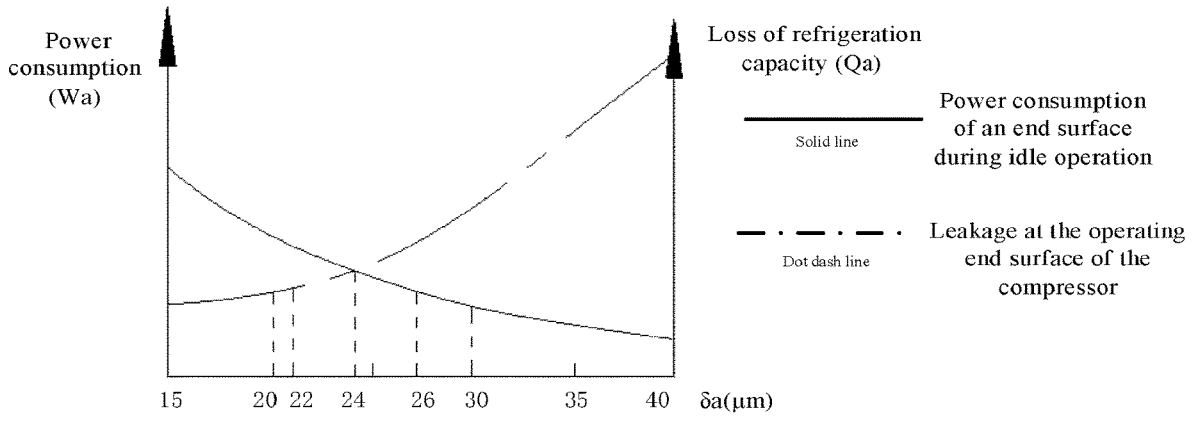
FIG. 13 is a curve graph of the relationship between the clearance δa and the power consumption Wa and the loss of refrigeration capacity Qa in the compressor shown in FIG. 1.

Therefore, as shown in FIG. 13, to reduce the power consumption Wa and the loss of refrigeration capacity Qa simultaneously, 20 μm<δa<30 μm should be satisfied. δa in the above range enables the power consumption Wa and the loss of refrigeration capacity Qa to be both near the lower values, then the design requirements of the power consumption Wa and the loss of refrigeration capacity Qa will be simultaneously satisfied.

Optionally, when 22 μm<δa<26 μm, the power consumption Wa and the loss of refrigeration capacity Qa are lower, and the performance of the compressor 100 will be in an optimal state.

In the description of the present disclosure, it is to be understood that the use of the words "first", "second", "third" and the like to limit the parts is merely to facilitate the differentiation of the above parts, unless otherwise stated, the above words do not have a special meaning, and therefore cannot be understood as a limitation to the protection scope of the present disclosure.

Finally, it should be noted that, the above embodiments are only used to illustrate, rather than limiting, the technical solution of the present disclosure; although the present disclosure is described in detail with reference to the preferred embodiments, those skilled in the art should understand that, specific embodiments of the present disclosure can still be modified or some of the technical features can be substituted equivalently; without departing from the spirit of the technical solution of the present disclosure, such modifications or equivalent substitutions shall all fall within the scope of the technical solutions claimed in the present disclosure.

The invention claimed is:

1. A compressor, comprising:

a first cylinder assembly, comprising a first cylinder body and a first sliding vane, wherein the first cylinder body is provided with a first compression cavity, a variable volume control cavity and a first sliding vane groove, and the first sliding vane groove communicates the first compression cavity with the variable volume control cavity, the first sliding vane is slidably arranged in the first sliding vane groove, and a part of the first sliding vane being configured to extend into the first compression cavity, and another part of the first sliding vane being configured to extend into the inside of the variable volume control cavity; and a variable volume control assembly, comprising a pressure regulator; wherein the pressure regulator is provided with a storage cavity, the storage cavity being configured to accommodate refrigerant, and the storage cavity is communicated with the variable volume control cavity; and wherein the first sliding vane is so configured that when the first sliding vane slides along the first sliding vane groove the size of the another part extending into the variable volume control cavity is changed, such that the volume of the variable volume control cavity is changed accordingly; along with the change of the volume of the variable volume control cavity, refrigerant is capable of flowing between the variable volume control cavity and the storage cavity, wherein the variable volume control assembly further comprises a control pipe, and the control pipe communicates the storage cavity with the variable volume control cavity, and wherein the minimum sectional area of the control pipe is S, the maximum sliding speed of the first sliding vane is Cmax, the thickness of the first sliding vane is b, the height of the first compression cavity is H, and $S>(1.57\times10^{-5})bHCmax$.

2. The compressor according to claim 1, wherein the effective volume of the storage cavity is Va, the volume of the variable volume control cavity is Vb, and the maximum variable value of Vb that varies along with the sliding of the first sliding vane is Vbmax, and the relationship between Va and Vbmax satisfies: $Va>5Vbmax$.

3. The compressor according to claim 2, wherein the relationship between Va and Vbmax satisfies: $Va>10Vbmax$.

4. The compressor according to claim 1, wherein the relationship between S and bHCmax satisfies: $S>(3.15\times10^{-5})bHCmax$.

5. The compressor according to claim 2, wherein the variable volume control assembly further comprises a control pipe, and the control pipe communicates the storage cavity with the variable volume control cavity;

the variable volume control assembly further comprises an inlet flow channel, wherein the inlet flow channel comprises a pressure input port being configured to introduce refrigerant, and an outlet communicated with the storage cavity; and the plane in which the outlet is located is a first boundary surface, the plane in which the end, communicated with the storage cavity, of the control pipe is arranged is a second boundary surface, and the volume between the first boundary surface and the second boundary surface in the storage cavity is the effective volume of the storage cavity.

6. The compressor according to claim 5, wherein one end of the control pipe extends into the storage cavity through the bottom of the storage cavity, and extends to the inside of the storage cavity.

7. The compressor according to claim 1, further comprising a second cylinder assembly, wherein the second cylinder assembly comprises a second cylinder body, a second roller, an upper flange and a baffle plate, the second cylinder body is provided with a second compression cavity, the second roller is arranged in the second compression cavity in a rotatable manner, the baffle plate is arranged between the first cylinder body and the second cylinder body, and the upper flange is arranged on a side, far away from the baffle plate, of the second cylinder body; and wherein the first cylinder assembly further comprises a first roller which is arranged in the first compression cavity in a rotatable manner, the clearance between the first roller and the baffle plate is $\delta a$, the clearance between the second roller and the upper flange is $\delta b$, and $\delta a>\delta b$.

8. The compressor according to claim 7, wherein $\delta a>\delta b+4$ μm.

9. The compressor according to claim 7, wherein 22 μm$<\delta a<$30 μm.

10. The compressor according to claim 9, wherein 22 μm$<\delta a<$26 μm.

11. An air conditioner, comprising the compressor according to claim 1.

12. The compressor according to claim 8, wherein 20 μm$<\delta a<$30 μm.

13. The compressor according to claim 12, wherein 22 μm$<\delta a<$26 μm.

* * * * *